United States Patent [19]

Phillips

[11] Patent Number: 4,521,166

[45] Date of Patent: Jun. 4, 1985

[54] INFLATABLE AIR PUMP

[76] Inventor: William E. Phillips, 6015 Varna Ave., Van Nuys, Calif. 91401

[21] Appl. No.: 372,639

[22] Filed: Apr. 28, 1982

Related U.S. Application Data

[63] Continuation-in-part of Ser. No. 317,436, Nov. 2, 1981, abandoned.

[51] Int. Cl.[3] ..... F04B 43/08; F04B 45/06; A47C 27/08

[52] U.S. Cl. ..... 417/478; 5/454; 92/48; 92/92

[58] Field of Search ..... 5/453, 454, 455, 456; 417/478; 92/92, 48

[56] References Cited

U.S. PATENT DOCUMENTS

| | | | |
|---|---|---|---|
| 527,248 | 10/1894 | North | 92/48 |
| 2,068,134 | 1/1937 | Houghton | 5/454 |
| 2,369,736 | 2/1945 | Hurt | 5/454 |
| 2,686,006 | 8/1954 | Hasselquist | 5/454 |
| 3,042,941 | 7/1962 | Marcus | 5/454 |
| 3,063,620 | 11/1962 | Black | 417/478 |
| 3,068,494 | 12/1962 | Pinkwater | 5/454 |
| 3,112,502 | 12/1963 | Forsberg | 5/454 |
| 3,583,008 | 6/1971 | Edwards | 5/454 |
| 3,676,276 | 7/1972 | Hirshen et al. | 5/455 |
| 4,003,098 | 1/1977 | Fink | 5/456 |

FOREIGN PATENT DOCUMENTS

| | | | |
|---|---|---|---|
| 74584 | 12/1960 | France | 5/455 |
| 2044531 | 2/1971 | France | 5/455 |

*Primary Examiner*—Alexander Grosz
*Attorney, Agent, or Firm*—Morgan, Finnegan, Pine, Foley & Lee

[57] ABSTRACT

An air pump includes a number of inflatable chambers forming a closed container which defines a pumping chamber. The container is fitted with one-way inlet and outlet valves to effectuate the pumping operation. In one embodiment, the container is cylindrical with seven to nine longitudinal air chambers forming the walls of the chamber. The ends of the cylindrical container are fitted with the inlet and outlet valves. Also disclosed is a method of making and of using such a pump.

26 Claims, 10 Drawing Figures

INFLATABLE AIR PUMP

CROSS REFERENCE TO RELATED APPLICATION

This application is a continuation-in-part of my copending U.S. patent application Ser. No. 317,436, filed Nov. 2, 1981, entitled Inflatable Air Pump and Method for Making an Air Pump now abandoned.

BACKGROUND OF THE INVENTION

1. Field of the Invention

The present invention relates to the field of portable and manually operated pumps and in particular relates to an inflatable air pump and a method for making the same.

2. Description of the Prior Art

It is well known in the prior art to use or incorporate a collapsible and flexible bellows in an air mattress and to simultaneously use the bellows as a pillow portion of the mattress. The incorporation of a flexible and collapsible bellows is illustrated by W. H. Hurt, "Pneumatic Mattress", U.S. Pat. No. 3,042,941.

It is also well known to incorporate a bellows within other portions of the mattress, such as the foot or corner as shown in J. M. Pinkwater, "Air Pump for Inflatable Structures", U.S. Pat. No. 3,068,494; E. S. Forsberg, "Pump For Air Mattresses", U.S. Pat. No. 3,112,502; and R. J. Edwards, "Compartmented Bag Having Selected Inflation Controls", U.S. Pat. No. 3,583,008.

However, such prior art pumps or bellows have incorporated either an internal means for giving the bellows resiliency, such as shown by Marcus, supra; Forsberg, supra; and Edwards, supra; or have relied upon the use of a material for the walls of the bellows which is inherently self-supporting and resilient such as used by Hurt, supra; Houghton, "Inflatable Bed or Mattress and the Like", U.S. Pat. No. 2,068,134; and Pinkwater, supra.

The result in each case is an air pump for inflatable mattresses or other inflatable structures which pump is relatively heavy and non-collapsible.

Reference may also be made to G. D. Black U.S. Pat. No. 3,063,620 entitled Self-Expandable Bag, showing a self-expandable bag for use in administering inhalant gas to a patient.

BRIEF SUMMARY OF THE INVENTION

The present invention is an inflatable pump comprising a plurality of inflated chambers collectively defining a completely enclosed internal chamber. The plurality of inflated chambers collectively form a self-supporting, resilient container. A valve means is disposed in the container to selectively permit ingress and egress of fluid or air from the internal chamber. By reason of this combination of elements, an extremely lightweight, compact and entirely collapsible pump is devised.

The present invention also includes a method for fabricating a self-supporting, resilient pump comprising the steps of forming a plurality of inflatable chambers. The plurality of chambers are then coupled along their edges to collectively form a container when the chambers are inflated. The container defines an internal chamber. Valve means are disposed in or on the container for the selective ingress and egress of fluid or air from the internal chamber.

Other objects and features will be in part apparent and in part pointed out hereinafter.

The present invention together with its various embodiments can be better understood by viewing the following drawings in connection with the detailed description of the preferred embodiments. In the drawings, like elements have been referenced by like numerals.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

The present invention involves an inflatable air pump which is rugged, reliable, inexpensive, extremely lightweight and entirely collapsible. Each of these objectives of the invention are achieved by forming the walls of the air pump from a combination of inflated chambers. In combination, the inflated chambers form a container wall of sufficient self-supporting resiliency that the wall resumes its undeformed shape after being compressed. The chambers also combine to form a closed container which defines an internal pumping chamber. The closed container, formed by the chambers, can be fitted with appropriate one-way valves to effectuate the pumping operation. Thus, as the container is deformed by hand or foot, air is forced from the internal pumping chamber through a one-way outlet valve into a delivery tube directly or into an object to be inflated. When the deforming force is removed from the container, it will resume its original shape due to its self-supporting resiliency thereby drawing fluid into the internal pumping chamber through a one-way inlet valve. No internal springs, resilient blocks or application of externally applied forces are necessary to cause the air pump to resume its original shape and thus to effectuate the intake stroke. The chambers are inflated to a sufficient degree such that when folded along a common weld which defines the boundary between chambers, the chambers walls come into contact. The contact between adjacent chambers gives the pump a resilient structure and assists in defining the pump's shape.

Figure 1:
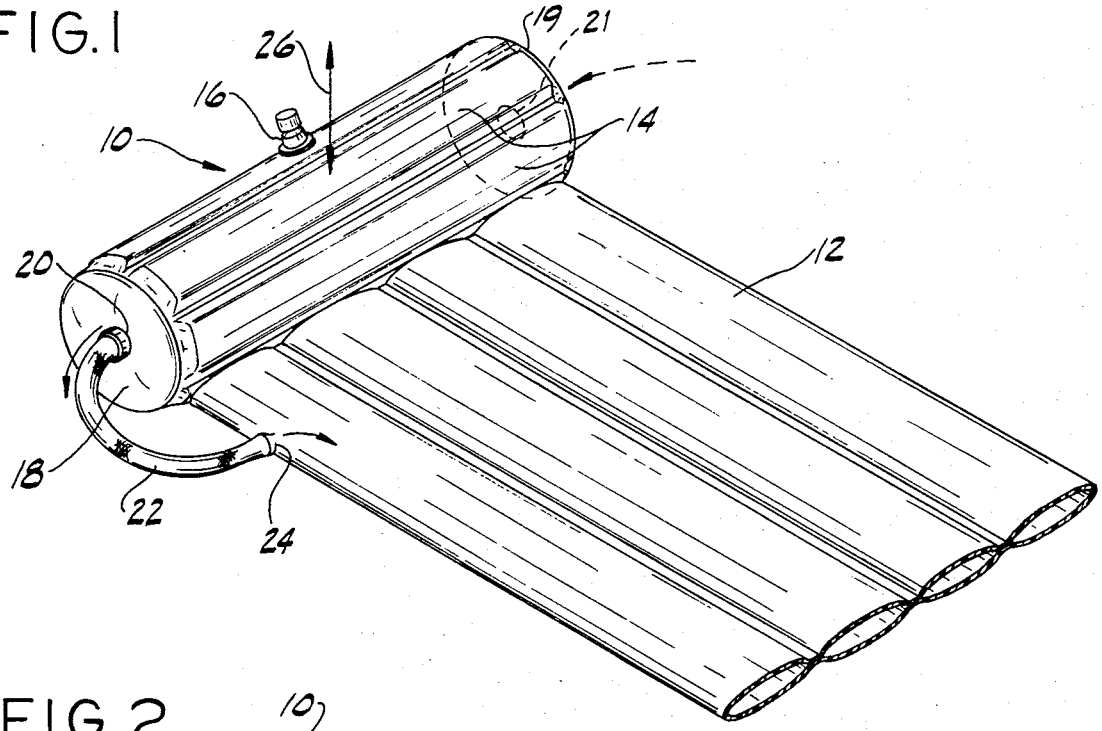
FIG. 1 is a perspective view of the present invention showing the environment of its use wherein an inflatable pump is used as a pillow for an air mattress and is shown coupled to the air mattress through a supply tube.

One application of the present invention is illustrated in FIG. 1 wherein the pump 10 is combined with an air mattress 12 to form a combination pillow and mattress set. The pump 10 is shown as having a generally cylindrical shape which is derived from a plurality of chambers 14. The chambers 14 are inflated through a conventional inflation valve 16 attached to one of the chambers. End chambers 18 and 19 of the pump 10 are each fitted with a one-way valve. End chamber 18 is fitted with the one-way outlet valve 20, while the opposing end chamber 19 is fitted with a one-way inlet valve 21. The outlet valve 20 is coupled to a delivery hose 22 which is shown as coupled to an inlet valve 24 of the mattress 12. The mattress can be inflated by deforming the pump 10 in the direction of the arrow 26. Of course, the pump can be used to inflate other inflatable items such as beach equipment, vinyl rafts and various toys.

Figure 2:
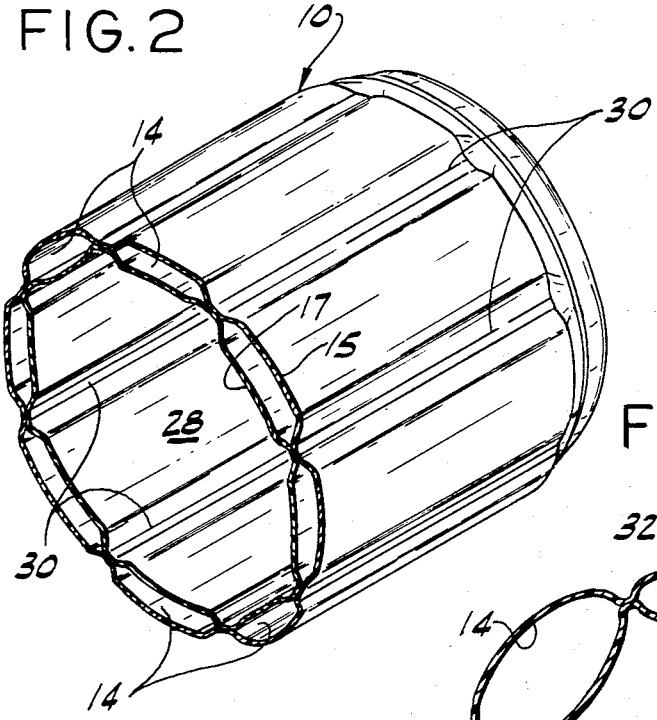
FIG. 2 is a partial perspective view showing a cutaway section formed by a plane disposed perpendicular to the longitudinal axis of the cylindrical pillow of FIG. 1.

The self-supporting characteristic of the pump 10 arises by virtue of its multi-paneled construction using the plurality of inflated chambers 14. As seen in FIG. 2 in perspective cross-section, eight inflated chambers formed by two sheets 15 and 17 in turn form a cylindrical shape. With the end chambers 18 and 19, a closed container is formed. The interior of the pump forms an internal pumping chamber 28. Each of the chambers 14 is at least partially separated from an adjacent chamber by a closure 30 formed by sealing or welding together the opposing wall sheets 15 and 17. Illustrated chambers 14, 18 and 19 interconnect so that they can all be inflated through valve 16.

The sheets forming the chambers may be of any material well known to the art from which inflatables are fabricated, such as plastic including vinyl, impregnated canvas and the like. In the preferred embodiment, polyurethane of 8 mil thickness is employed for its high elasticity when pump 10 is used as an air pump. In the application where pump 10 is used to pump a heavier fluid, such as water, 24 mil thick vinyl is preferred. The elasticity of the wall material of pump 10 is used to contribute at least in part to the pump's overall resiliency.

A substantial part of the flexibility and shape provided to the pump is determined by the combination of the welds 30 and the chambers 14. For example, FIG. 2 shows a cylindrical container having eight equally sized longitudinally disposed chambers which are coupled at teir ends by the end chambers. Most of the angular changes between the chambers 14 occur at the welds 30 which act as hinges. Generally, the weld width must be carefully controlled to be no more than one eighth of an inch to insure that the weld 30 folds substantially on a single line. Larger weld widths tend to give pump 10 a looser and more floppy structure. In addition, chambers 14 are inflated to a sufficient degree to cause inner wall 17 to contact inner wall portions of adjacent chambers 14. Each chamber 14 thus rests upon the adjacent chambers 14 to form a self-supporting resilient structure. Thus, by selection of appropriate sizes for the chamber and the weld lines 30, the desired size and shape of the pump can be obtained.

It has been found that in a pump of the type illustrated in FIG. 2, the best results are acheived by forming a closed container having equal sized, longitudinally disposed chambers 14 no less than seven in number and no more than nine in number. With less than seven equal sized, longitudinal chambers, the volume of the internal pumping chamber 28 is too small and the efficiency of the pump or the volume that can be pumped on each stroke is too low. A combination of only two or three inflated chambers would reduce the volume of the internal pumping chamber to a nonworkable size. If more than nine inflated chambers are combined, the pump loses its self-supporting ability and it tends to sag because an insufficient degree of contact between adjacent chambers is established. For example, if too many inflated chambers were employed, it could be expected that the side walls of the pump would collapse or flatten under their own weight. Thus, optimum results are achieved in the preferred embodiment by combining seven to nine equal sized inflated chambers to form the longitudinal walls of the pump shown in FIG. 2. It has been found that the width of the chambers is immaterial and that the pump can be successfully fabricated regardless of the width of chambers as long as the present teaching is observed. Again, inflation must be sufficient to produce the desired degree of contact between adjacent chambers.

Figure 3:
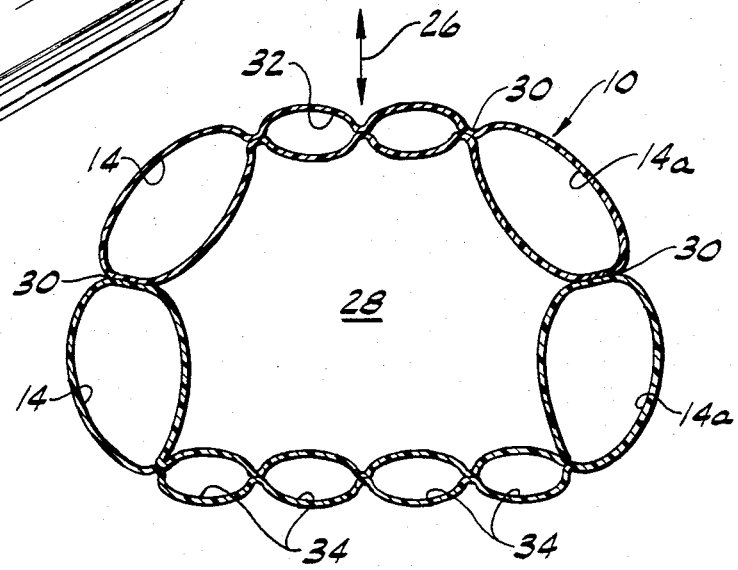
FIG. 3 is a cross-sectional elevational view of an alternative embodiment of the air pump as shown in FIG. 2 wherein flattened top and bottom portions have been provided.

FIG. 3 illustrates another embodiment of the type of pump as shown in FIG. 2 and demonstrates the exploitation of the principle of adjacent contact for self-supporting structure and resiliency. An upper chamber of the pump **10*a* in FIG. 3 has been subdivided into two co-equal but smaller chambers 32. The combined width of the chambers 32 is approximately equal to the width of one chamber 14*a*. Similarly, two chambers at the bottom of the pump of FIG. 3 have been subdivided into equal halves to form a base comprised of four smaller chambers 34. The width of the base of the pump formed by the chambers 34 is approximately twice the width of one of the chambers 14*a***.

The inclusion of the smaller chambers 32 and 34 form preferred top and bottom surfaces and serves to orient the pump. A foot plate (not shown) can be attached or imprinted by conventional means to the top surface of the chambers 32 to provide a visual direction for operation of the pump. The flat bottom allows a user to orient the pump for easiest operation. The inclusion of the smaller chambers does not substantially interfere with the self-supporting resiliency of the pump which is maintained by side-by-side chambers **14*a*. In either the embodiment of FIG. 2 or 3, the degree of contact of adjacent chambers depends on the details of pump design, wall elasticity, inflation fluid and pumped fluid. For example, the embodiment of FIG. 3 must be inflated with slightly more pressure than that of FIG. 2 since most of the resiliency and structure is produced by the smaller number of chambers 14*a*. If water is to be pumped and the pump is air inflated, it must be inflated at a higher pressure than if only air were pumped to compensate for the water's greater weight. If pump 10** is water inflated, wall thickness and material must be selected to give the strength and elasticity to accomodate the heavier, incompressible water used for inflation.

Figure 4:
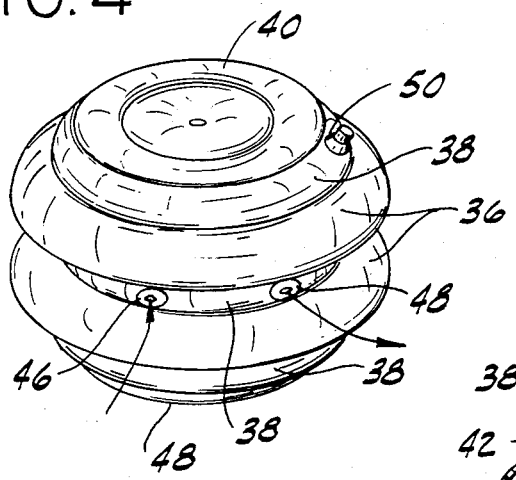
FIG. 4 is a perspective view of another embodiment wherein the walls of the pump are made of circular rings which alternate in diameter.

An alternative embodiment of the pump is illustrated in FIG. 4 and is comprised of alternating circular (toroidal) chambers 36 and 38 forming a cylindrical container having end-caps 40 and 41. The circular chambers 38 assume an average first diameter which is less than an average second diameter for the larger chambers 36.

Figure 5:
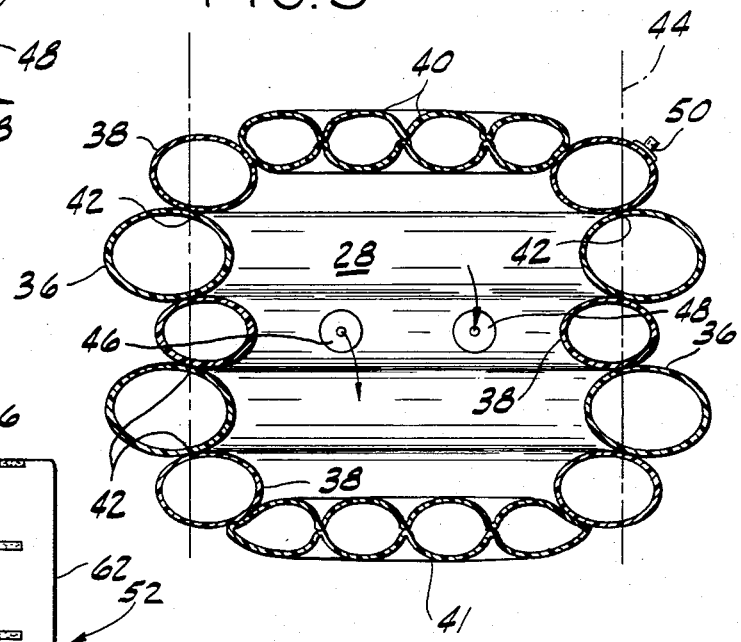
FIG. 5 is an enlarged cross-sectional elevational view of the pump shown in FIG. 4.

FIG. 5 illustrates in cross-section the embodiment of FIG. 4 and more clearly depicts the relationship of the chambers 36 and 38. Each smaller chamber 38 is adjacent to a larger chambers 36 so as to alternate. The chambers 36 and 38 are coupled, such as by welding or other conventional means to each other along circular lines of contact 42. These lines of contact are shown in FIG. 44. The end caps 40 and 41 are conventionally welded at lines of tangential contact to their adjacent chambers 36 and 38 as the case may be. A conventional one-way inlet valve 46 and a conventional one-way outlet valve 48 are provided through one or more of chambers 36 and 38. End cap 40 is pumped by exerting a force in direction 26. The embodiment of FIG. 5 is particularly adapted for service as a water pump while the embodiments of FIGS. 2 and 3 operate efficiently as air pumps. The chambers 36 and 38 are inflated through a conventional inflation valve 50. Each of the chambers 36 and 38, and end caps 40 and 41 are intercommunicated such that fluid inserted into the upper chamber 38 is eventually transported to each of the underlying chambers 36 and 38. Intercommunication can be made through the line of contacts 42 by providing internal holes or slits for passages in the weld area. End caps 40 and 41 are inflated concentric rings and serve to preserve a measure of rigidity to the ends of the pump. End caps 40 and 41 are inflated concentric rings and serve to preserve a measure of rigidity to the ends of the pump. End caps 40 and 41 could be replaced by rigid disks, however, the object of providing a completely collapsible, soft and lightweight pump would be lost thereby. Replacement of inflated end caps 40 and 41 by flexible end sheets would seriously affect the efficiency of the pump.

Figure 6:
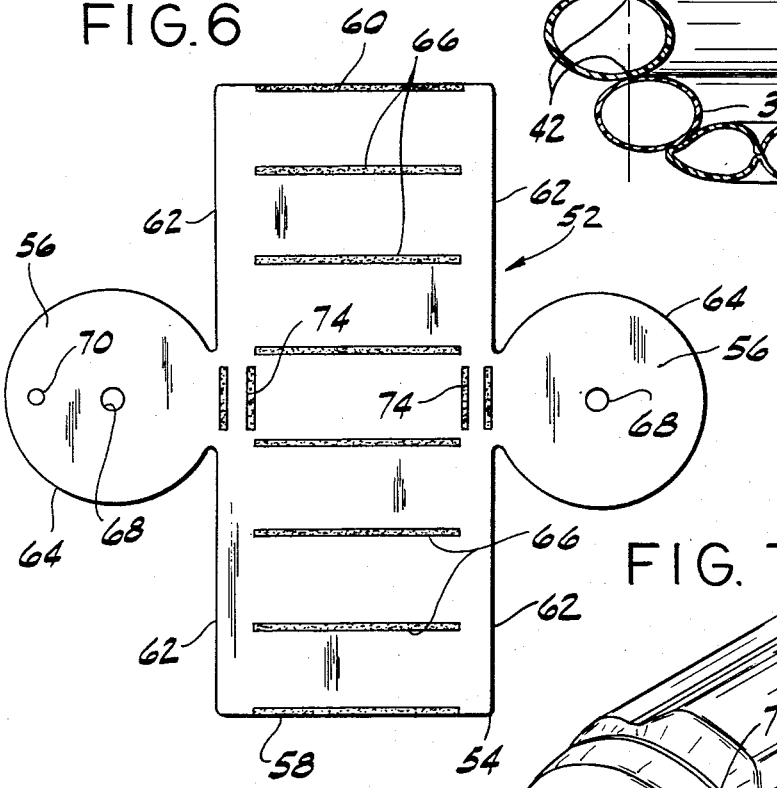
FIG. 6 is a plan view of die cut sheets which can be assembled according to the method of the present invention to result in a pump of the type shown in FIG. 2.

FIG. 6 illustrates a plan view of material cut to form the air pump of the type shown in FIG. 2. The method of the present invention is illustrated by considering the construction of an inflatable air pump from a pattern 52. The pattern is comprised of a generally rectangular sheet 54 having generally circular extensions 56 formed between ends 58 and 60 of the sheet.

Two sheets of the pattern 52 are die cut according to conventional means from nonporous material, such as polyurethane or vinyl, and overlaid to assume the plan view shown in FIG. 6. The perimeter of the two sheets is then sealed or welded airtight by conventional means (e.g. heat sealing). Thus, an airtight weld is provided along the ends 58 and 60, the sides 62 and the circular edges 64. At the same time, seven longitudinal panels are formed by welding six longitudinal seams 66 across most of the width of the sheet in a direction generally parallel to the ends 58 and 60. Circular valve openings 68 are provided in the circular extensions for the one-way inlet and outlet valves, and a circular opening 70 is provided in one of the circular extensions 56 and through only one of the sheets for placement of the inflation valve. In fact, an inflation valve 72 shown in FIG. 7, can be installed in sheet 54 through hole 70 after sheet 54 has been die cut and prior to its overlay and welding to a second sheet.

The seams 66 extend only partially across sheet 54 to allow intercommunication between each chamber formed thereby. In the pattern 52, intercommunication is provided around each end of the seams. In addition, short perpendicular seams 74 are provided near the circular extensions 56. Thus, the extensions also intercommunicate with the longitudinal chambers formed by the seams 66. The seams 74 allow for a more gradual bending between the interconnection of the circular extensions and the body of the pump formed by the rectangular portion of the sheets.

After sealing, the ends 58 and 60 are then brought into contact and coupled or welded by conventional means. The resulting structure is an open-ended cylinder with two end-flaps formed by the circular extensions. The open-ended cylinder is placed within a conventional die can which forms and holds a cylindrical shape while the edges 64 of circular extensions are coupled or conventionally welded to the edges 62 of the open cylindrical shape formed by the sheets.

Figure 7:
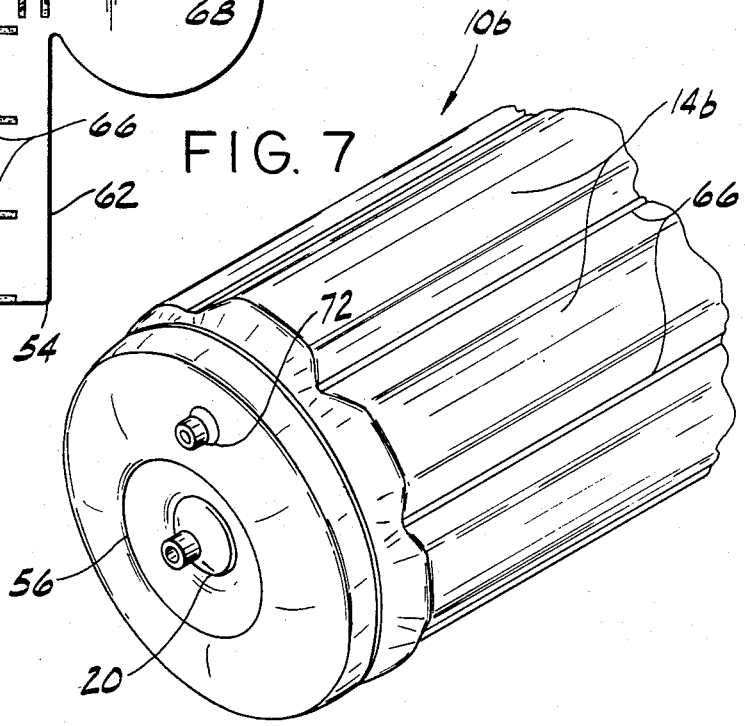
FIG. 7 is a perspective view of an assembled pump from the pattern of FIG. 6.

The assembled device comprises a pump **10*b* shown in FIG. 7 in an inflated condition. The circular extensions form the ends which are fitted with an end mounted inflation valve 72 and a one-way inlet or outlet valve 20*b*. The area between the seams 66 define inflated chambers 14*b*. As pump 10*b* is inflated the average cylindrical diameter decreases and each weld or seam 66 moves closer to an adjacent weld or seam 66. Usually, very little stretching of wall material occurs during inflation, so that the chamber wall bulge out as the welds draw toward each other. During the pumping action, the wall material may be elastically deformed, particularly if the inflating fluid is incompressible. As the cylinder diameter decreases, the end cap 56 diameter decreases as well. By appropriate experimental selection of relative chamber 14*b* width to end cap 56 diameter, the decrease in cylinder diameter can be matched to the decrease in end cap 56 diameter. The similar relationship is observed in the embodiments of FIGS. 1–5**.

It can now be understood how the combination of chambers 14 are made and used to achieve a rugged, inexpensive, lightweight, resilient and self-supporting and entirely collapsible air pump. A rather larger internal pumping chamber can be devised using a relatively small amount of material to form the pump walls. After use, the pump can be entirely collapsed, folded and inserted into a pocket on an air mattress, life raft, life jacket or other inflatable device. Because of the inexpensive construction, a pump of the type described here can be included as a backup air pump in any case where CO2 cartridges or other automatic means are used to inflate the inflatable device. Low weight of the pump recommends its use in those applications where the pump must be individually carried in a pack or weight and size constraints are critical.

The pump is reliable because of its simplified construction and lack of complex moving parts. It is rugged because of its pneumatic construction and material and yet inexpensive.

The pump is lightweight because of its pneumatic design, and the ratio of volume of air pumped to punp weight is very high. Also, because of its completely pneumatic design the pump is entirely collapsible and thus easily stored.

In another aspect, the inflatable pump of this invention comprises a casing of relatively thin, flexible fluid-impervious sheet material, constituted for example by the tubular body formed from the rectangular portions 54 of the two sheets or plies cut to the pattern 52 and the end walls 18 and 19, adapted for being distended from a generally flat collapsed condition (when deflated) to the expanded hollow condition illustrated in FIGS. 1 and 2 defining pump chamber 28 therewith. The casing, when in the stated expanded condition, is adapted to be squeezed as indicated by the arrow 26 for pumping fluid (air) from the pump chamber 28, having outlet means 20 for delivery of fluid from the pump chamber on squeezing the casing to effect a pumping stroke, and inlet means 21 for delivery of fluid (air) to the pump chamber on re-expansion of the casing following squeezing. The casing is formed to have a plurality of elongate inflatable cells, e.g. 14, which themselves are adapted to be inflated with fluid (air) via valve 16 from a generally flat collapsed deflated condition to an expanded inflated condition for distending the casing. The cells 14 extend in generally parallel relation with adjacent cells joined by portions 30 of the casing material between adjacent cells. These portions 30 are of such narrow width relative to the width of the cells 14 that adjacent cells, when inflated to distend the casing, are interengageable on squeezing the casing, whereby the cells are squeezed and thereby compressed to establish a compressive return force in the casing for re-expanding it following the squeezing to effect a return stroke for delivery of fluid (air) to the pump chamber 28 for the next pumping stroke. Said portions 30 of the casing act as hinges on which the adjacent cells may pivot one relative to another and squeeze one another when the casing is squeezed. Thus, in FIG. 3, note particularly the engagement of the two cells at the left and the two cells at the right. As made in accordance with FIG. 6, the casing comprises inner and outer plies of the sheet material and portions 30 are seals, e.g. heat seals, between the plies of relatively narrow width and spaced apart to form the cells.

Figure 8:
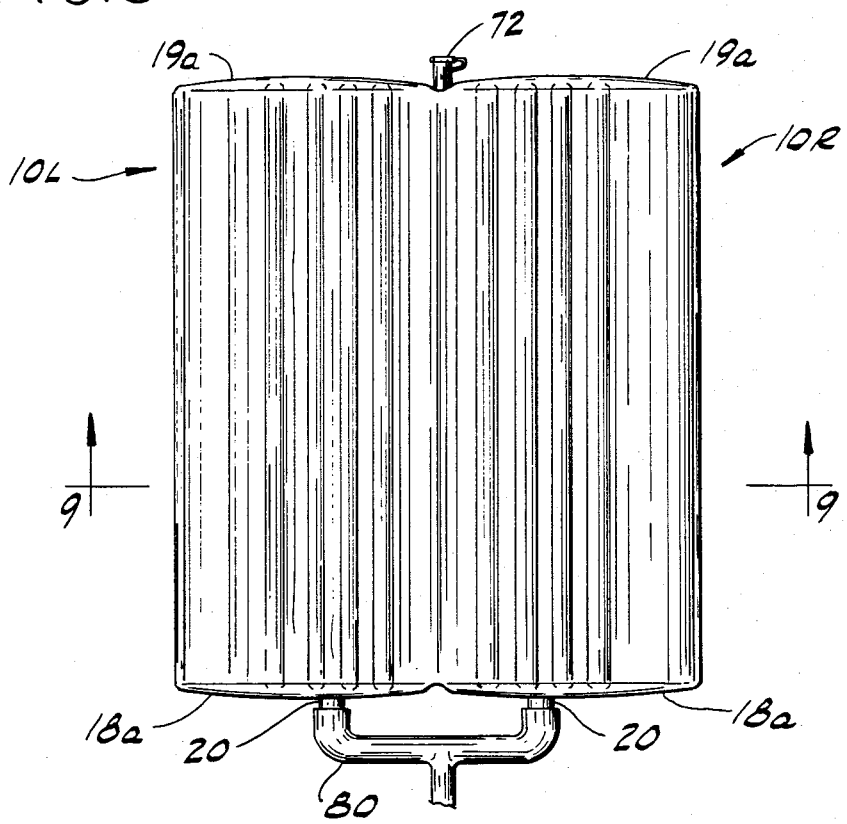
FIG. 8 is a plan of a dual inflatable pump of this invention.
Figure 9:
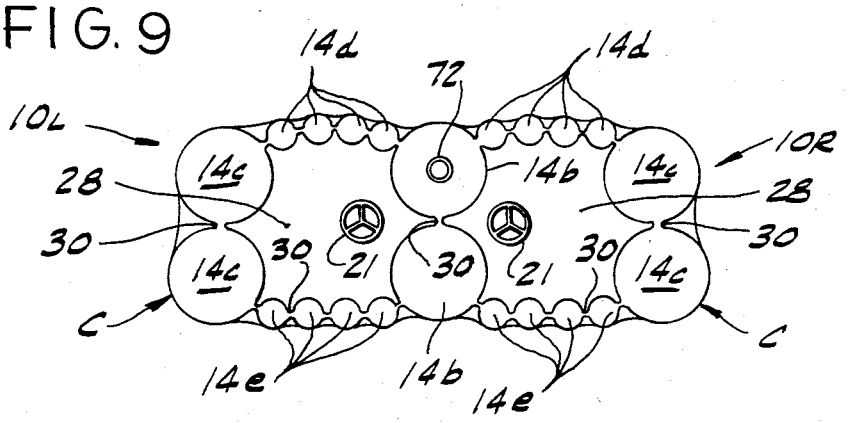
FIG. 9 is a diagrammatic section on line 9—9 of FIG. 8.
Figure 10:
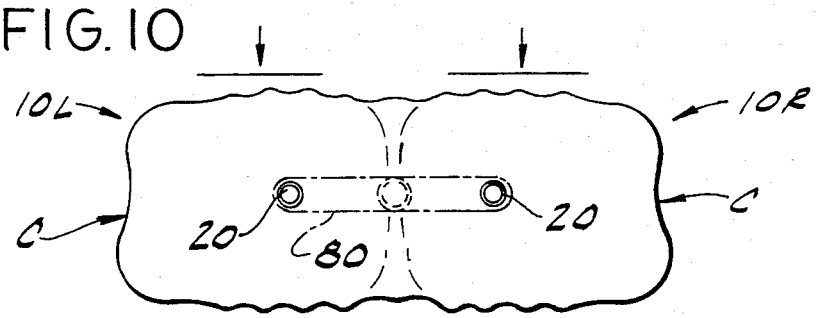
FIG. 10 is an end view of the FIG. 8 pump.

FIGS. 8–10 illustrate a dual inflatable pump of this invention comprising two pump sections 10L and 10R, each adapted to be squeezed by stepping on it with the foot, or by pressing it with the hand, for pumping fluid therefrom. Each of these pump sections is made generally like the pump illustrated in FIG. 3, comprising a casing C of relatively thin, flexible, fluid-impervious sheet material adapted for being distended from a generally flat collapsed condition to the expanded hollow condition in which it appears in FIGS. 8–10 defining pump chamber 28 therewithin. Each casing, when in its expanded condition, is adapted to be squeezed for pumping fluid from the pump chamber therewithin, and has check-valved outlet means indicated at 20 for delivery of fluid from the pump chamber on squeezing it to effect a pumping stroke, and check-valved inlet means 21 for delivery of fluid to the pump chamber on re-expansion of the casing following squeezing. Each casing C is itself inflatable to distend it from its generally flat collapsed condition to its expanded hollow condition. The two pump sections 10L and 10R are in side-by-side position for squeezing one pump section and then the other by stepping on one pump section with the left foot while raising the right foot and stepping on the other pump section with the right foot while raising the left foot (or by squeezing one pump section with the left hand while releasing the right hand from the other pump section and squeezing the other pump section with the right hand while releasing the left hand from the one pump section). Note the arrows in FIG. 10. The outlet means 20 of the two pump sections are interconnected as indicated at 80 for substantially continuous (i.e. relatively uninterrupted) delivery of fluid by the alternate squeezing of the two pump sections.

The two pumps 10L, 10R have what may be termed a common wall 82 constituted by two inflatable cells **14*b* shown as being relatively large cells, with their interconnecting hinge as indicated at 30. The outside wall of each pump is constituted by two cells 14*c* relatively large like cells 14*b*, with their interconnecting hinges as indicated at 30. The top and bottom of each pump section comprises smaller cells 14*d* and 14*e*, with their interconnecting hinges as indicated at 30. The end walls 18*a* and 19*a* of each pump section are doublewalled as in the pumps of FIGS. 1–3 and 7. The cells are intercommunicating for their inflation and deflation via an inflation and deflation fitting at 72**.

Many alterations and modifications may be made to the disclosed embodiments without departing from the spirit and scope of the present invention. The presently referred embodiments have been illustrated by way of example only and for the sake of clarity and are not intended to limit the scope and breadth of the following claims.

What is claimed is:

1. An inflatable pump comprising:

a plurality of inflated chambers collectively and substantially exclusively defining a completely enclosed internal chamber, said plurality of inflated chambers collectively and substantially exclusively forming a self-supporting, resilient container; and valve means disposed in said container to selectively permit fluid to ingress and egress said internal chamber; whereby an extremely lightweight, compact, collapsible pump is devised.

2. The pump of claim 1 wherein said plurality of inflated chambers number between nine (9) and eleven (11) including two end inflated chambers.

3. The pump of claim 1 wherein said plurality of inflated chambers comprises:

a plurality of circular inflated chambers; and two end caps;

whereby said container is formed and is made self-supporting and resilient.

4. The pump of claim 3 wherein each circular chamber is disposed during normal operation in a plane perpendicular to the force exerted on said pump to operate it.

5. The pump of claim 1 wherein said inflated chambers are mutually intercommunicated whereby fluid may be transported among said plurality of inflated chambers.

6. An air pump comprising:

a plurality of longitudinally disposed inflatable chambers coupled to adjacent chambers along longitudinal lines;

two inflatable end chambers, each coupled to one end of said longitudinal chambers, each longitudinal and end chamber communicating with adjacent chambers coupled thereto to permit transport of air among said chambers, said longitudinal and end chambers forming a container when inflated, said container defining an internal pumping chamber; and valve means disposed in said end chambers for selective ingress and egress of air from said internal pumping chamber.

7. The pump of claim 6 where the number of equal sized longitudinal chambers number no less than seven (7) and no more than nine (9) chambers.

8. An inflatable object comprising:

an air pump having a plurality of longitudinally disposed inflatable chambers coupled to adjacent chambers along longitudinal lines, two inflatable end chambers, each coupled to one end of said longitudinal chambers, each longitudinal and end chamber communicating with adjacent chambers coupled thereto to permit transport of air among said chambers, said longitudinal and end chambers forming a container when inflated, said container defining an internal pumping chamber, valve means disposed in said end chambers for selective ingress and egress of air from said internal pumping chamber; and inflatable means connected to said air pump and in communication with a portion of said valve means for receiving air from said pump so as to expand, and another portion of said valve means communicating with the ambient air.

9. An inflatable pump comprising a casing of relatively thin, flexible, fluid-impervious sheet material adapted for being distended from a generally flat collapsed condition to an expanded hollow condition defining a pump chamber therewithin, the casing, when in its expanded condition, being adapted to be squeezed for pumping fluid from said pump chamber, and having outlet means for delivery of fluid from said pump chamber on squeezing the casing to effect a pumping stroke and inlet means for delivery of fluid to the pump chamber on re-expansion of the casing following squeezing, the casing being formed to have a plurality of elongate inflatable cells which themselves are adapted to be inflated with fluid for expanding from a generally flat collapsed deflated condition to an expanded inflated condition for distending the casing, said cells extending in generally parallel relation with adjacent cells joined by portions of the casing material between adjacent cells, said portions being of such narrow width relative to the width of the cells that adjacent cells, when inflated to distend the casing, are inter-engageable upon squeezing the casing, and that said cells substantially exclusively form said pump chamber whereby the cells are squeezed and thereby compressed to establish a compressive return force in the casing for re-expanding it following the squeezing to effect a return stroke for delivery of fluid to the pump chamber for the next pumping stroke.

10. An inflatable pump as set forth in claim 9 wherein the portions of the casing between adjacent cells act as hinges on which the adjacent cells may pivot one relative to another and squeeze one another when the casing is squeezed.

11. An inflatable pump as set forth in claim 10 wherein the casing comprises two plies of relatively thin flexible fluid-impervious material, one constituting an inner ply and the other an outer ply, said plies being sealed together by seals of relatively narrow width with said seals spaced apart to form the inflatable cells, said seals constituting the said hinge portions of the casing between adjacent cells.

12. An inflatable pump as set forth in claim 11 having an air inlet in the outer ply of the casing for blowing air into one of the cells, and having passages between the cells for inflation of all the cells by blowing air into said one cell.

13. An inflatable pump as set forth in claim 12 wherein the casing comprises two plies of heat-sealable plastic film, and the seals are heat seals.

14. An inflatable pump as set forth in claim 13 wherein the seals are no wider than about one-eighth of an inch.

15. An inflatable pump as set forth in claim 9 wherein the casing comprises a tubular body and end walls closing the ends of the tubular body, the inflatable cells and said portions of the casing material between adjacent cells extending longitudinally of the tubular body, said portions acting as hinges on which adjacent cells may pivot one relative to another when the tubular body is squeezed laterally.

16. An inflatable pump as set forth in claim 15 wherein the tubular body of the casing is formed of two plies of relatively thin flexible air-impervious sheet material, one constituting an inner ply and the other an outer ply, said plies being sealed together by seals of relatively narrow width extending longitudinally of the tubular body with said seals spaced apart girthwise of the tubular body to form the inflatable cells, said seals constituting the said hinge portions of the tubular body between adjacent cells.

17. An inflatable pump comprising:

a plurality of inflated chambers collectively defining a completely enclosed internal chamber and forming a self-supporting, resilient container, said plurality of inflated chambers comprising:

a first plurality of longitudinally disposed inflated chambers, each joined along their longitudinal edges to an adjacent longitudinally disposed inflated chamber, and two end inflated chambers, each end inflated chamber joined to adjacent ends of each longitudinal inflated chamber; and valve means disposed on said container to selectively permit fluid to ingress or egress said internal chamber;

to define an extremely lightweight, compact and collapsible pump which is substantially self-supporting and resilient.

18. The pump of claim 17 wherein said container has a top and bottom, said top being formed by dividing one said longitudinal chamber in half to form two smaller longitudinal chambers, and said bottom being formed by dividing each of two of said longitudinal chambers in half to form four smaller longitudinal chambers.

19. The pump of claim 17 wherein said valve means is disposed in said end inflated chambers.

20. An inflatable pump comprising:

a plurality of inflated chambers collectively defining a completely enclosed internal chamber and forming a self-supporting, resilient container, said plurality of inflated chambers comprising a plurality of generally circular inflated chambers with a pair of end caps to enclose said internal chamber, each said circular chamber being disposed in a plane generally perpendicular to a pumping force exerted on said pump during normal operation and each said circular chamber being joined to an adjacent circular chamber along a line offset from the average radius of each said circular chamber; and valve means disposed in said container to selectively permit fluid to ingress and egress said internal chamber;

to define an extremely lightweight, compact and collapsible pump which is essentially self-supporting and resilient.

21. The pump of claim 20 wherein each one of said plurality of circular chambers have either a first or second average diameter, said first diameter being smaller than said second, each circular chamber having said first diameter being adjacent only to said circular chambers having said second diameter and vice versa, the centers of said diameters of said circular chambers being generally aligned along a central axis of said pump.

22. An inflatable pump comprising a casing of relatively thin, flexible, fluid-impervious sheet material adapted for being distended from a generally flat collapsed condition to an expanded hollow condition defining a pump chamber therewithin, the casing, when in its expanded condition, being adapted to be squeezed for pumping fluid from said pump chamber, and having outlet means for delivery of fluid from said pump chamber on squeezing the casing to effect a pumping stroke and inlet means for delivery of fluid to the pump chamber on re-expansion of the casing following squeezing, the casing comprising a tubular body formed of a plurality of elongate inflatable cells which themselves are adapted to be inflated with fluid for expanding from a generally flat collapsed deflated condition to an expanded inflated condition for distending the casing, with inflatable end walls closing said tubular body at its ends, said cells extending in generally parallel relation, generally longitudinally of the tubular body, with adjacent cells joined by portions of the casing material between adjacent cells, said portions being of such narrow width relative to the width of the cells that adjacent cells, when inflated to distend the casing, are interengageable upon squeezing the casing, said portions acting as hinges on which adjacent cells may pivot one relative to another when the tubular body is squeezed laterally whereby the cells are squeezed and thereby compressed to establish a compressive return force in the casing for re-expanding it following the squeezing to effect a return stroke for delivery of fluid to the pump chamber for the next pumping stroke.

23. An inflatable pump as set forth in claim 22 wherein the tubular body and the end walls of the casing are formed of two plies of relatively thin flexible air-impervious sheet material, one constituting an inner ply and the other an outer ply, the plies in the tubular body being sealed together by seals of relatively narrow width extending longitudinally of the tubular body with said seals spaced apart girthwise of the tubular body to form the inflatable cells, said seals constituting the said hinge portions of the tubular body between adjacent cells.

24. An inflatable pump as set forth in claim 23 having an air inlet in the outer ply of the tubular body for blowing air into one of the cells, the seals being such as to provide for passages between the cells for inflation of all the cells by blowing air into said one cell, and said cells being in communication with the space between plies in the end walls for inflating the end walls.

25. An inflatable pump as set forth in claim 24 wherein the plies are heat-sealable plastic film and the seals are heat seals.

26. An inflatable pump as set forth in claim 25 wherein the seals are no wider than about one-eighth of an inch.

* * * * *